US011407610B2

(12) United States Patent
Bessac et al.

(10) Patent No.: US 11,407,610 B2
(45) Date of Patent: Aug. 9, 2022

(54) EQUIPMENT TETHER

(71) Applicant: Fiskars Brands, Inc., Middleton, WI (US)

(72) Inventors: Grant Denton Bessac, Beaverton, OR (US); Charles Hartzell, Portland, OR (US)

(73) Assignee: FISKARS BRANDS, INC., Middleton, WI (US)

( * ) Notice: Subject to any disclaimer, the term of this patent is extended or adjusted under 35 U.S.C. 154(b) by 457 days.

(21) Appl. No.: 16/480,120

(22) PCT Filed: Jan. 22, 2018

(86) PCT No.: PCT/US2018/014702
§ 371 (c)(1),
(2) Date: Jul. 23, 2019

(87) PCT Pub. No.: WO2018/140356
PCT Pub. Date: Aug. 2, 2018

(65) Prior Publication Data

US 2019/0389687 A1 Dec. 26, 2019

Related U.S. Application Data

(60) Provisional application No. 62/451,522, filed on Jan. 27, 2017.

(51) Int. Cl.
*B65H 75/44* (2006.01)
*B65H 75/40* (2006.01)

(52) U.S. Cl.
CPC ..... *B65H 75/4431* (2013.01); *B65H 75/406* (2013.01); *B65H 75/4471* (2013.01); *B65H 2701/35* (2013.01)

(58) Field of Classification Search
None
See application file for complete search history.

(56) References Cited

U.S. PATENT DOCUMENTS 2,866,436 A 12/1958 Swain et al.
4,846,090 A * 7/1989 Palmquist ..... B63B 21/16 114/230.23

(Continued)

FOREIGN PATENT DOCUMENTS

DE 19930092 1/2001
JP 2002-362792 A 12/2002
WO WO-2012/149625 A1 11/2012

OTHER PUBLICATIONS

International Search Report and Written Opinion for International Application No. PCT/US2018/014702, dated May 10, 2018, 11 pages.

*Primary Examiner* — William A. Rivera
(74) *Attorney, Agent, or Firm* — Foley & Lardner LLP

(57) ABSTRACT

A tether includes a housing defining a cord aperture, a spool located within the housing and configured to rotate about a spool axis in either an extending direction or a rewinding direction, a cord wound around the spool and configured to pass through the cord aperture, a biasing member coupled to the spool, and a retractor lock. The biasing member biases the spool to rotate in the rewinding direction to retract the cord into the housing. The retractor lock is movable between a locked position and an unlocked position. The retractor lock prevents rotation of the spool when in the locked position and allows rotation of the spool in the unlocked position. The retractor lock is moves from the locked position to the unlocked position in response to a threshold cord force on the cord.

22 Claims, 19 Drawing Sheets

(56) References Cited

U.S. PATENT DOCUMENTS

| | | | | |
|---|---|---|---|---|
| 6,199,785 | B1 * | 3/2001 | Paugh | B65H 75/4431 242/378.1 |
| 6,290,158 | B1 * | 9/2001 | Huang | G01B 3/11 242/379 |
| 7,665,684 | B2 * | 2/2010 | Salentine | A45F 5/004 242/379.2 |
| 8,220,676 | B1 * | 7/2012 | Hicks | B65H 75/48 224/162 |
| 8,678,255 | B2 * | 3/2014 | Zhang | B65H 75/4434 224/162 |
| 2005/0150920 | A1 | 7/2005 | Schuster et al. | |
| 2012/0279461 | A1 * | 11/2012 | Levell | A01K 27/004 119/794 |
| 2014/0116354 | A1 | 5/2014 | Harris, II | |

* cited by examiner

EQUIPMENT TETHER

CROSS-REFERENCE TO RELATED APPLICATIONS

This application is a U.S. national stage application of International Patent Application No. PCT/US18/014702, filed Jan. 22, 2018, which claims the benefit of and priority to U.S. Provisional Patent Application No. 62/451,522, filed Jan. 27, 2017, the entire contents of both applications are incorporated herein by reference.

BACKGROUND

The present invention relates generally to the field of tool storage devices and in particular to the field of tool storage devices that facilitate accessing hand tools.

BRIEF DESCRIPTION OF THE DRAWINGS

The invention will become more fully understood from the following detailed description, taken in conjunction with the accompanying drawings, in which.

DETAILED DESCRIPTION

Figure 1:
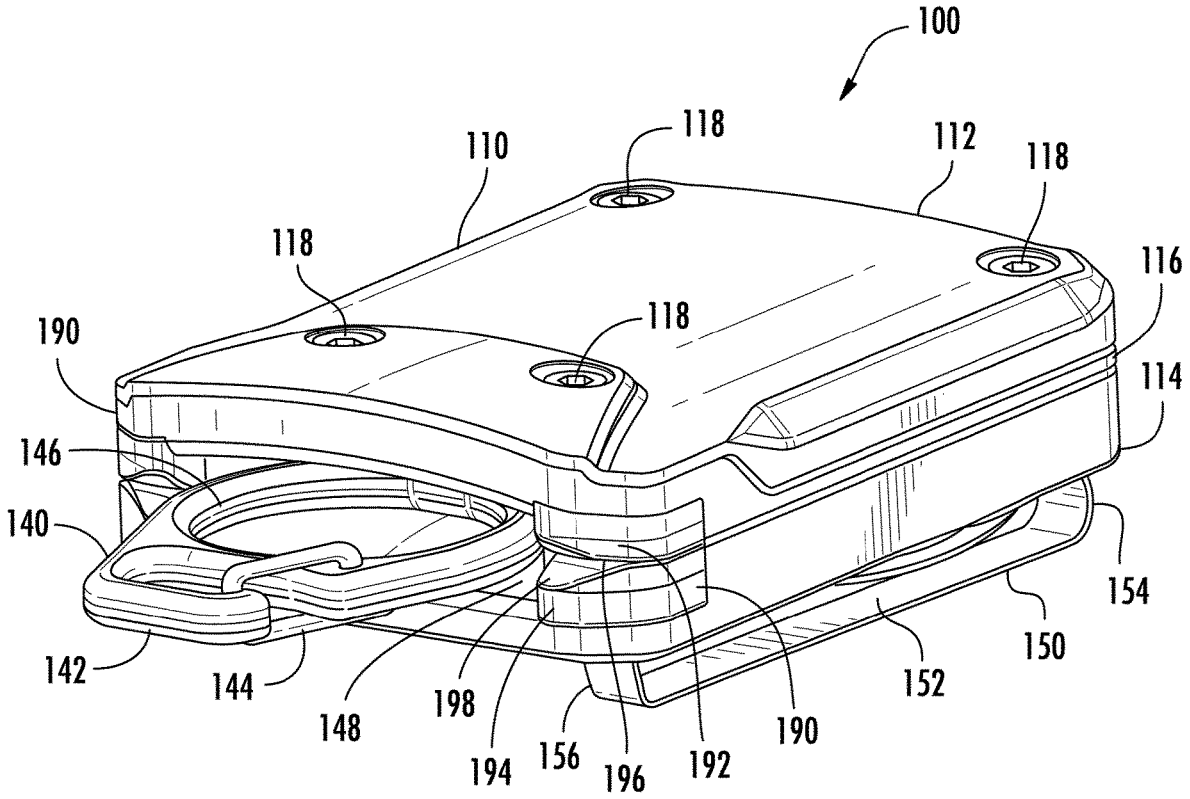
FIG. 1 is a perspective view of an equipment tether, according to an exemplary embodiment.
Figure 2:
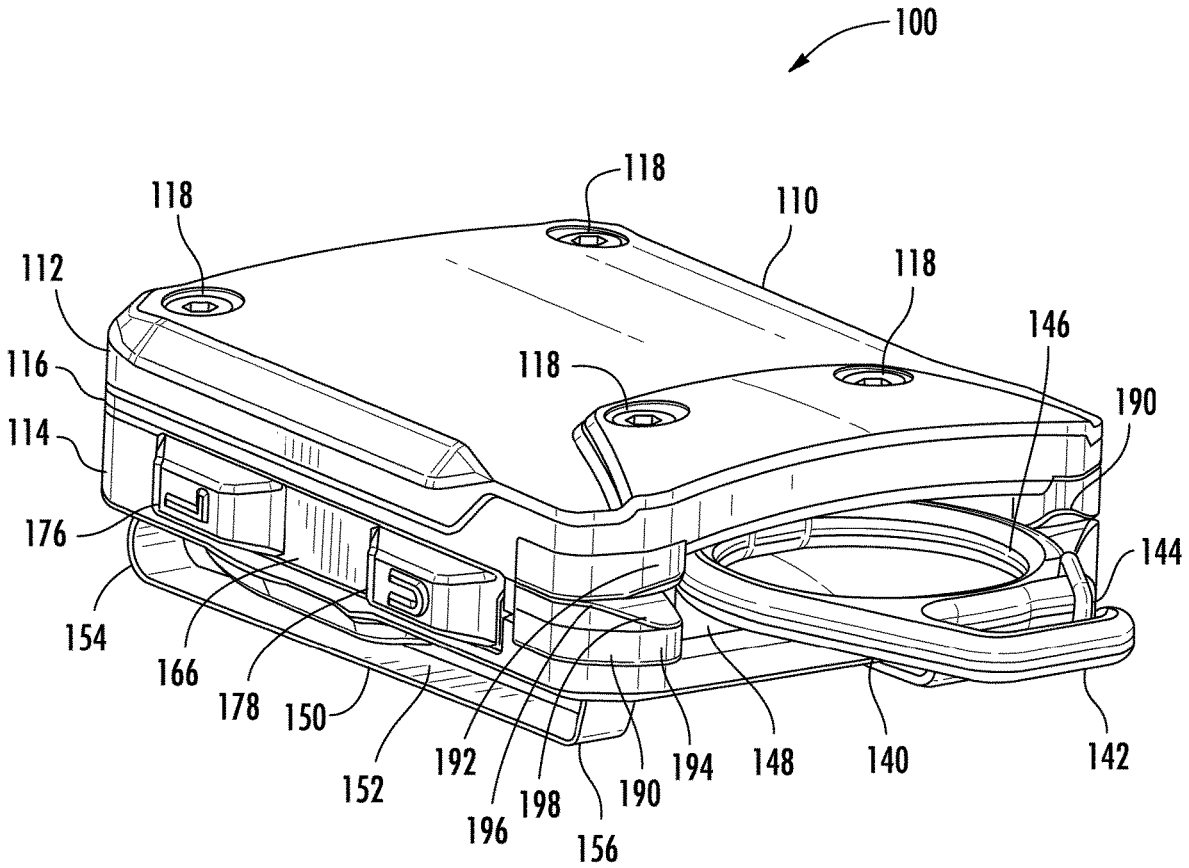
FIG. 2 is another perspective view of the equipment tether of FIG. 1.
Figure 3:
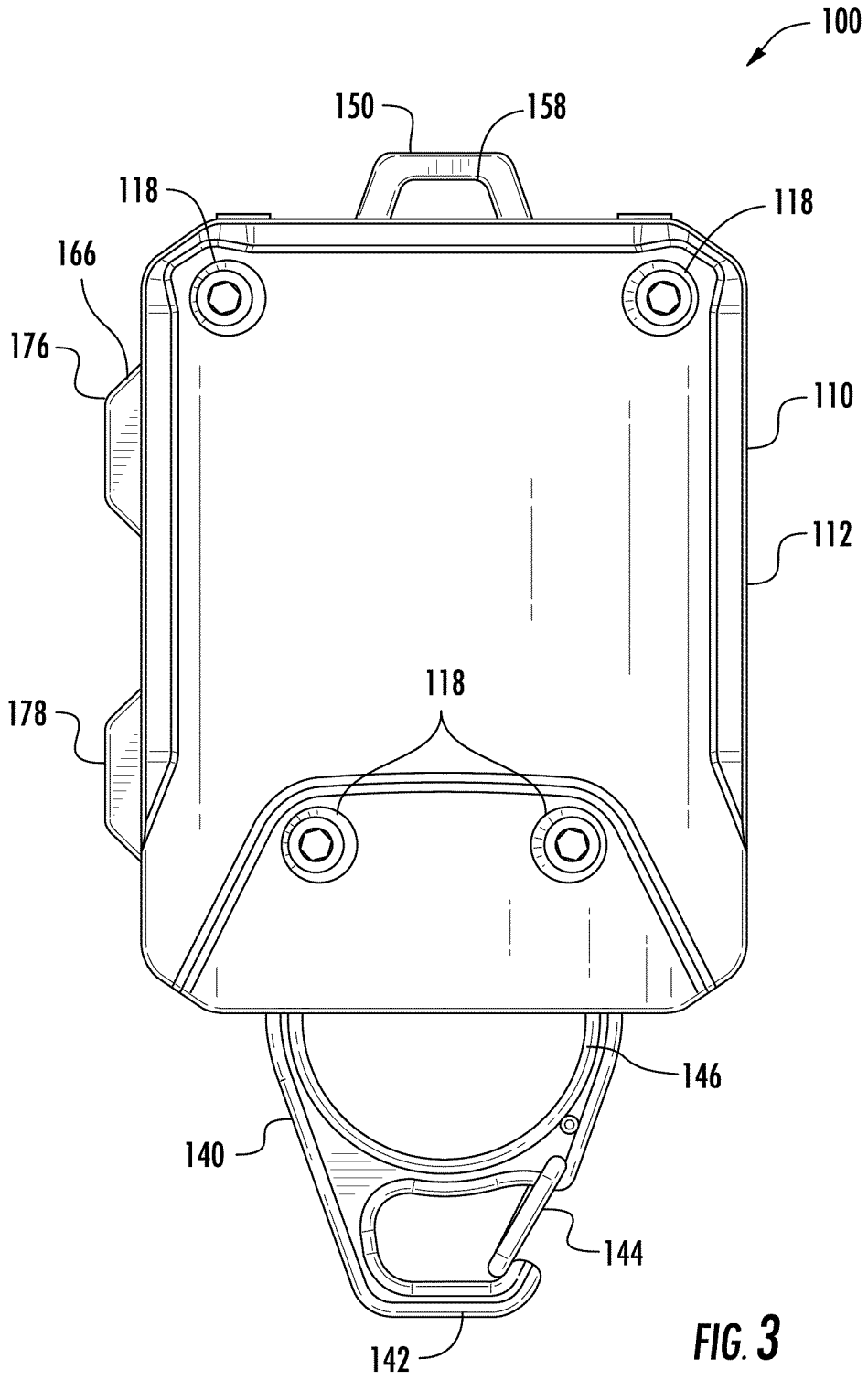
FIG. 3 is a top view of the equipment tether of FIG. 1.

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

An equipment tether is configured to tether an object to an operator. The equipment tether allows the user to secure a tool (e.g., pliers, a knife, a multi-tool, etc.) for easy access. According to various exemplary embodiments, the equipment tether includes a cord wound around a spool that is connected to the user and a spring that biases the spool to rotate to retract the cord. The cord is connected to a carabiner, which is used to connect the equipment tether to a tool. The equipment tether prevents tools from accidentally being lost. By way of example, a user may connect the equipment tether to the user's belt and to a pair of needle-nose pliers while fishing on a boat. The equipment tether keeps the pliers just below waist height for easy access and prevents the pliers from being lost overboard. The design presented in various embodiments described herein additionally includes various methods of selectively preventing movement of the carabiner and retraction of the cord, which results in a greater degree of user control when using or storing (e.g., allowing to hang by the user's side) the tool connected to the tether.

Referring to FIGS. 1-6, an equipment tether 100 is illustrated according to an exemplary embodiment. The equipment tether 100 includes a housing 110. The housing 110 includes a top cover 112, a bottom cover 114, and a spacer 116. The top cover 112 and the bottom cover 114 are coupled to opposite sides of the spacer 116 using threaded fasteners 118. In other embodiments, the top cover 112, the bottom cover 114 and the spacer 116 are coupled using other means (e.g., adhesive, clips, etc.). In some embodiments, the spacer 116 is omitted. In other embodiments, the housing 110 includes a greater or lesser number of parts. In some embodiments, the housing 110 includes various raised and recessed surfaces to facilitate alignment and assembly of the various parts of the equipment tether 100.

Figure 6:
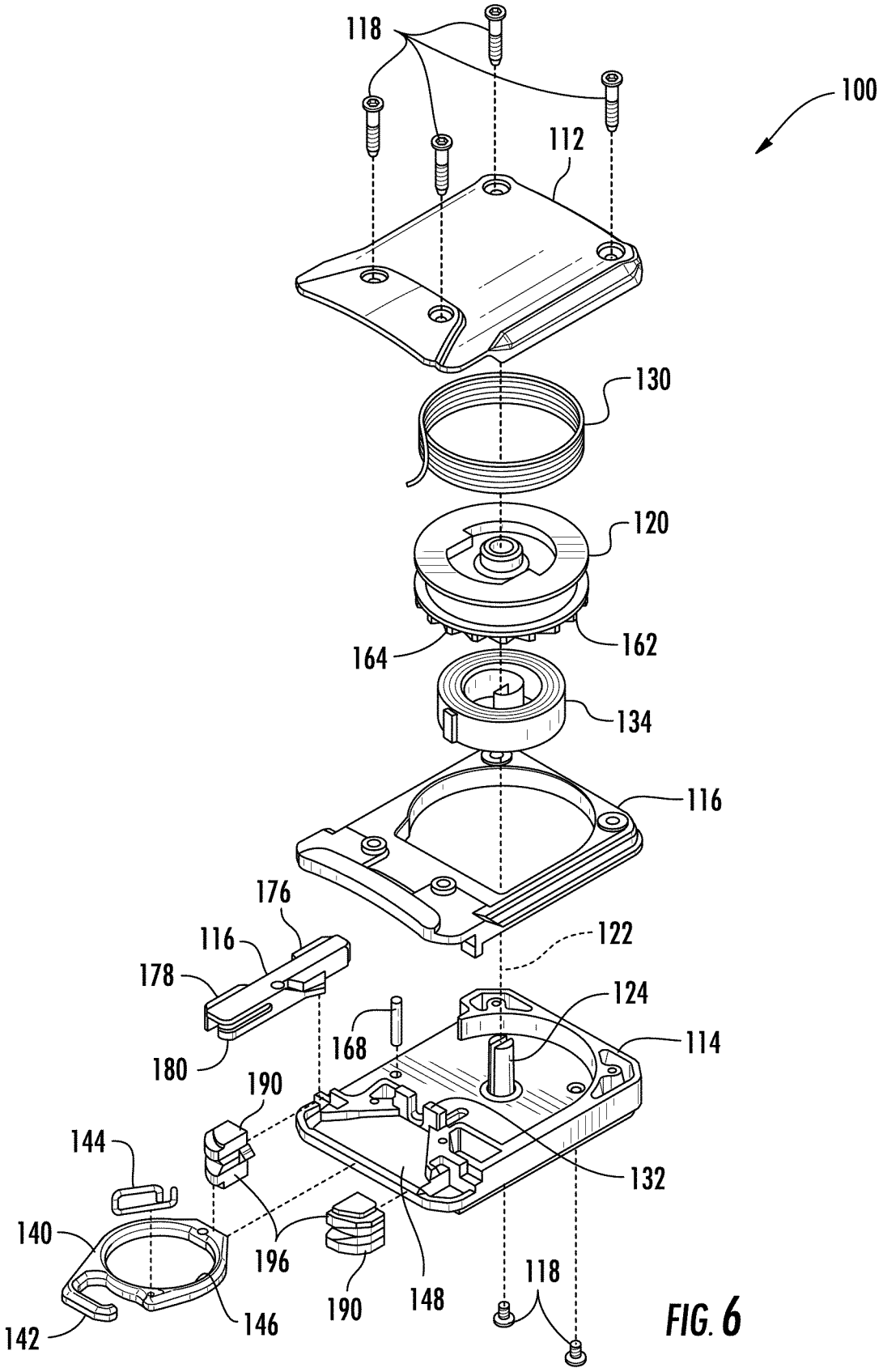
FIG. 6 is an exploded view of the equipment tether of FIG. 1.

Referring to FIG. 6, the equipment tether 100 includes a spool 120 located within the housing 110. The spool 120 rotates about a spool axis 122 which passes through the center of spool axle 124. In the embodiment shown in FIG. 6, the spool axle 124 is formed into the housing 110, but in other embodiments, the spool axle 124 is otherwise formed (e.g., a pin that passes through the center of spool 120 is received by an indentation in the housing 110, the spool 120 includes a raised surface that is received by an indentation in the housing 110, etc.). A cord 130 is wound around the spool 120 and passes through a cord aperture 132 in the housing 110. In some embodiments, the cord aperture 132 is centered laterally on the housing 110. The cord 130 is wound around the spool 120 such that when the cord 130 is pulled out of the housing 110 through the cord aperture 132, the spool 120 rotates in an extending direction. When the spool 120 rotates in an opposite rewinding direction, the cord 130 is rewound on the spool 120. In some embodiments, an end of the cord 130 is attached to the surface of the spool 120 such that in the event that the cord 130 is completely unwound from the spool 120, the cord 130 is still connected to the spool 120.

The equipment tether 100 includes a spool biasing member 134 (e.g., a spring, an elastic member, etc.) coupled to the housing 110 and the spool 120. The spool biasing member 134 biases (e.g., by means of a biasing force or torque) the spool 120 to rotate in the rewinding direction. When the spool 120 is rotated in the extending direction (e.g., by a tensile force on the cord 130), the spool biasing member 134 opposes the motion. If the cord 130 is extended and subsequently allowed to move freely, the spool biasing member 134 will force the spool 120 to rotate, rewinding the cord 130. In some embodiments, the properties of the spool biasing member 134 (e.g., the spring rate), are varied to optimize the holding characteristics of the equipment tether 100. By way of example, in different embodiments, the spring rate may be varied to hold an object of a certain weight or to allow for a user to easily pull the cord 130 from the housing 110.

Referring to FIGS. 1-6, the equipment tether 100 includes a carabiner 140 connected to the distal end of the cord 130. The carabiner 140 is used to selectively couple the equipment tether 100 to other objects. By way of example, the carabiner 140 may be used to connect to a lanyard ring on a knife. The cord 130 is fully retracted when the carabiner 140 contacts the housing 110 and prevents the cord 130 from retracting further. In some embodiments the carabiner 140 forms a carabiner hook 142 and includes a carabiner spring 144. The carabiner spring 144 is located partially inside the carabiner hook 142 and is biased towards the carabiner hook 142. The carabiner spring 144 covers a portion of the opening to the carabiner hook 142, trapping an object (e.g., a ring, a loop of rope, etc.) on the carabiner hook 142. A force can be applied to the carabiner spring 144 to deflect the carabiner spring 144 inwards, freeing the object. In other embodiments, the carabiner hook 142 and the carabiner spring 144 are replaced with another means of connecting an object to the carabiner 140 (e.g., a clip, another type of hook, a key ring, etc.). The carabiner 140 additionally defines a carabiner aperture 146. The housing 110 defines a carabiner recess 148 located such that the cord aperture 132 opens into (i.e., is connected to) the carabiner recess 148. The carabiner 140 is received by the carabiner recess 148 and enters partially inside of the housing 110 when the cord 130 is fully retracted. The carabiner recess 148 contacts the carabiner 140, preventing the carabiner 140 from moving.

Figure 4:
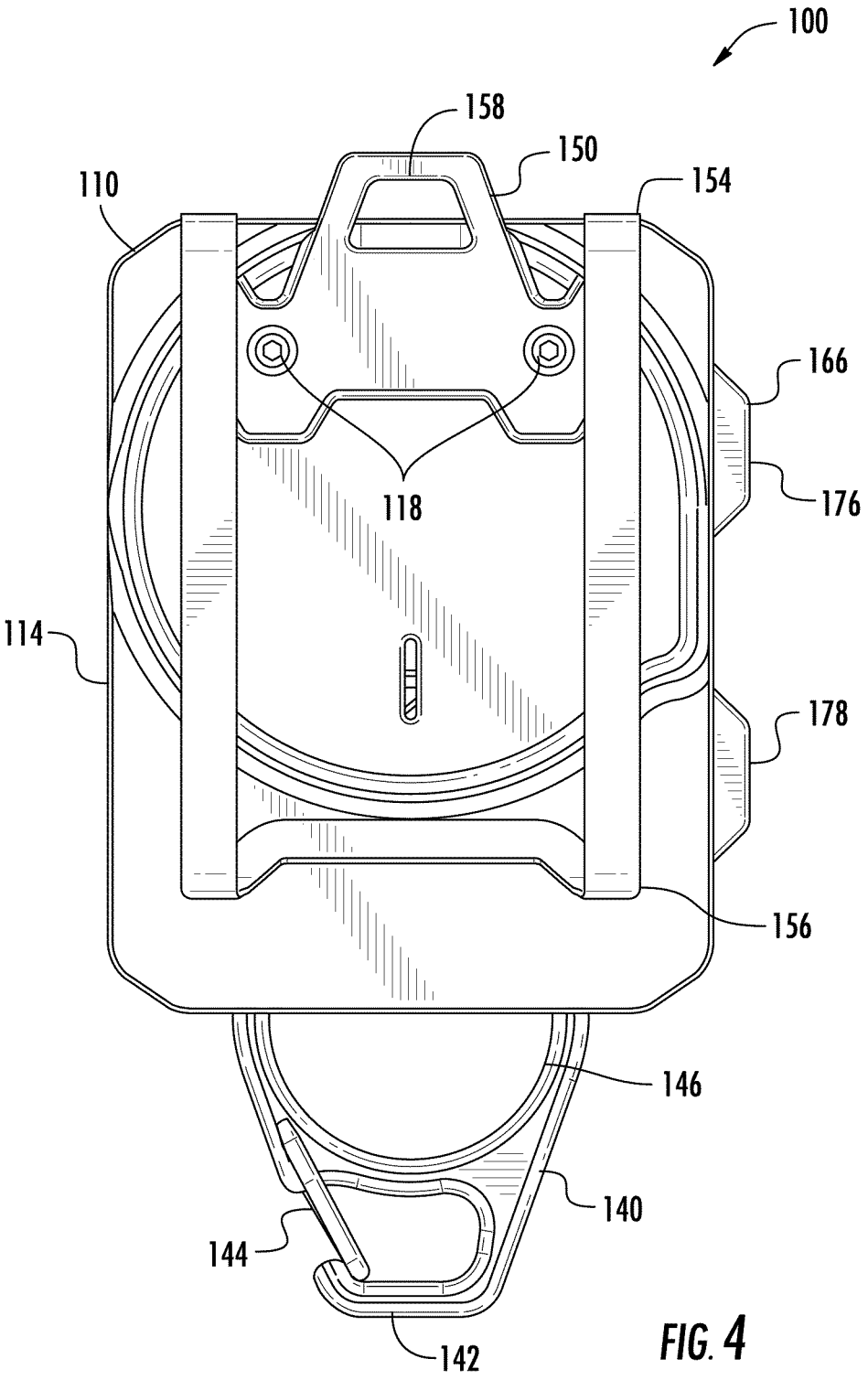
FIG. 4 is a bottom view of the equipment tether of FIG. 1.
Figure 5:
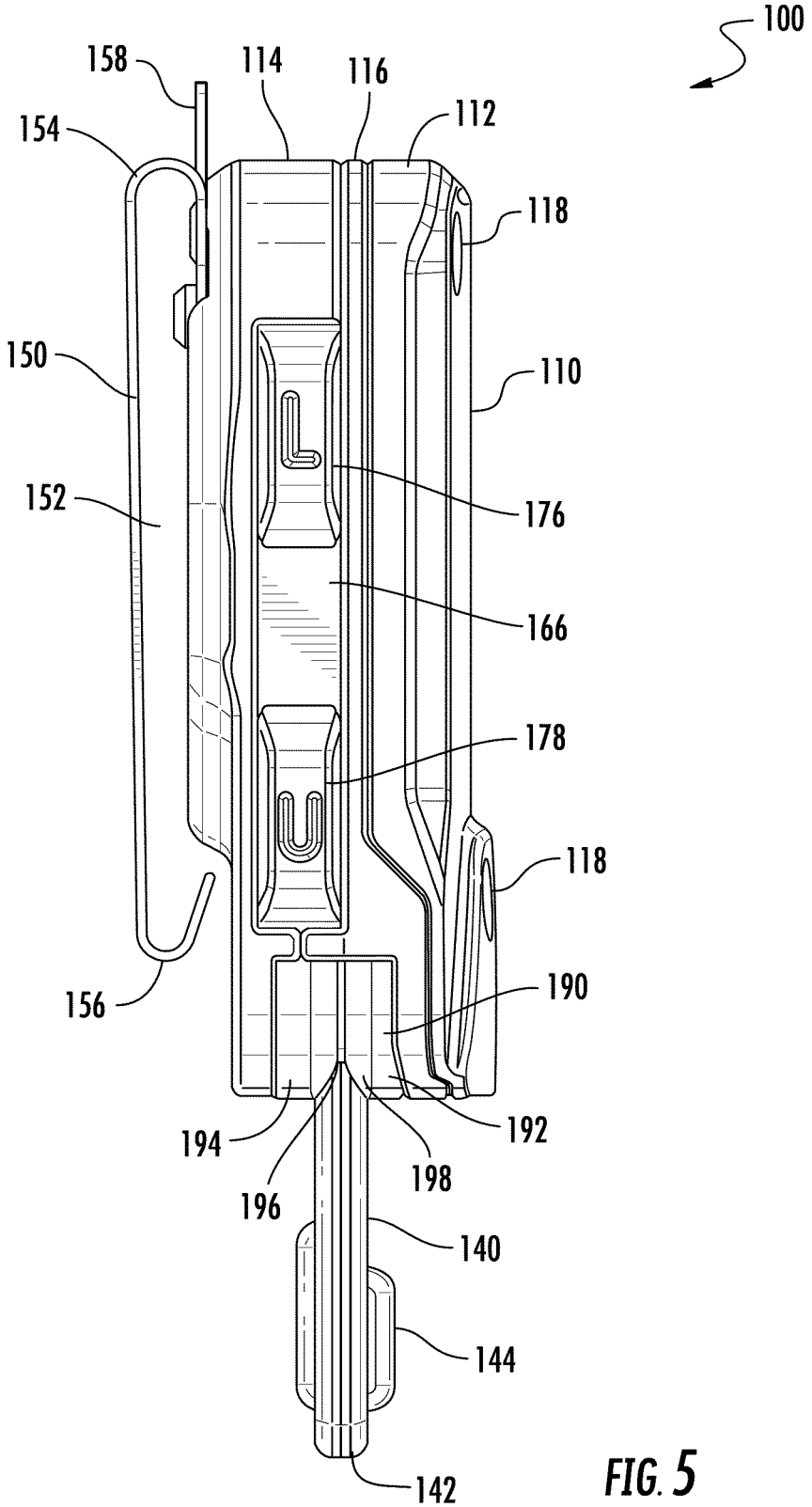
FIG. 5 is a side view of the equipment tether of FIG. 1.

Referring to FIGS. 4 and 5, the equipment tether 100 includes a belt clip 150 coupled to the housing 110. The belt clip 150 is used to secure the equipment tether 100 to a desired location (e.g., a user's belt, a tool or tackle box, a mounting location on a boat, etc.). In some embodiments, the belt clip 150 is made from a flexible metal to facilitate bending the belt clip 150 and having the belt clip 150 return to its original shape. In other embodiments, the belt clip 150 is rigid. The belt clip 150 defines a belt loop 152. The belt loop 152 is configured to surround a belt worn by the user to facilitate securing the equipment tether 100 to the user. In some embodiments, the belt loop 152 includes top hook 154 and bottom hook 156. The top hook 154 and the bottom hook 156 extend around the top and bottom surfaces of the belt to secure the equipment tether 100 to the belt. The top hook 154 is coupled to the housing 110 using fasteners 118. In other embodiments, the top hook 154 is coupled to the housing 110 using other means (e.g., adhesive, clips, etc.). In some embodiments, the bottom hook 156 is also coupled to the housing 110. In other embodiments, the bottom hook 156 is not coupled to the housing 110 and allows the belt to slide between the bottom hook 156 and the housing 110 into the belt loop 152. The belt clip 150 also includes a lanyard aperture 158. The lanyard aperture 158 serves as an interface through which to connect the equipment tether 100 to another object. By way of example, the lanyard aperture 158 may serve as an interface to which a lanyard may be tied.

Figure 7:
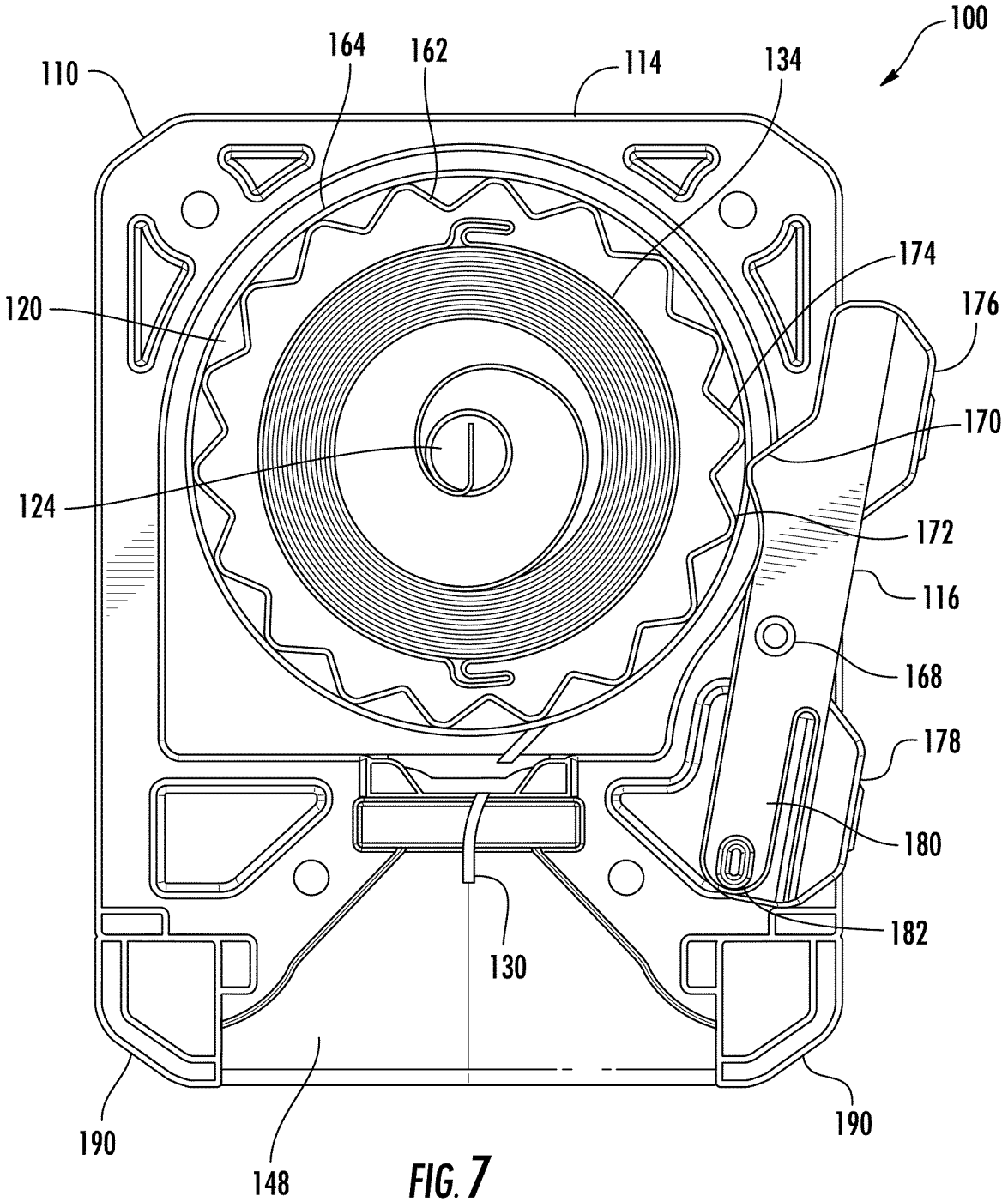
FIG. 7 is a section view of the equipment tether of FIG. 1.
Figure 8:
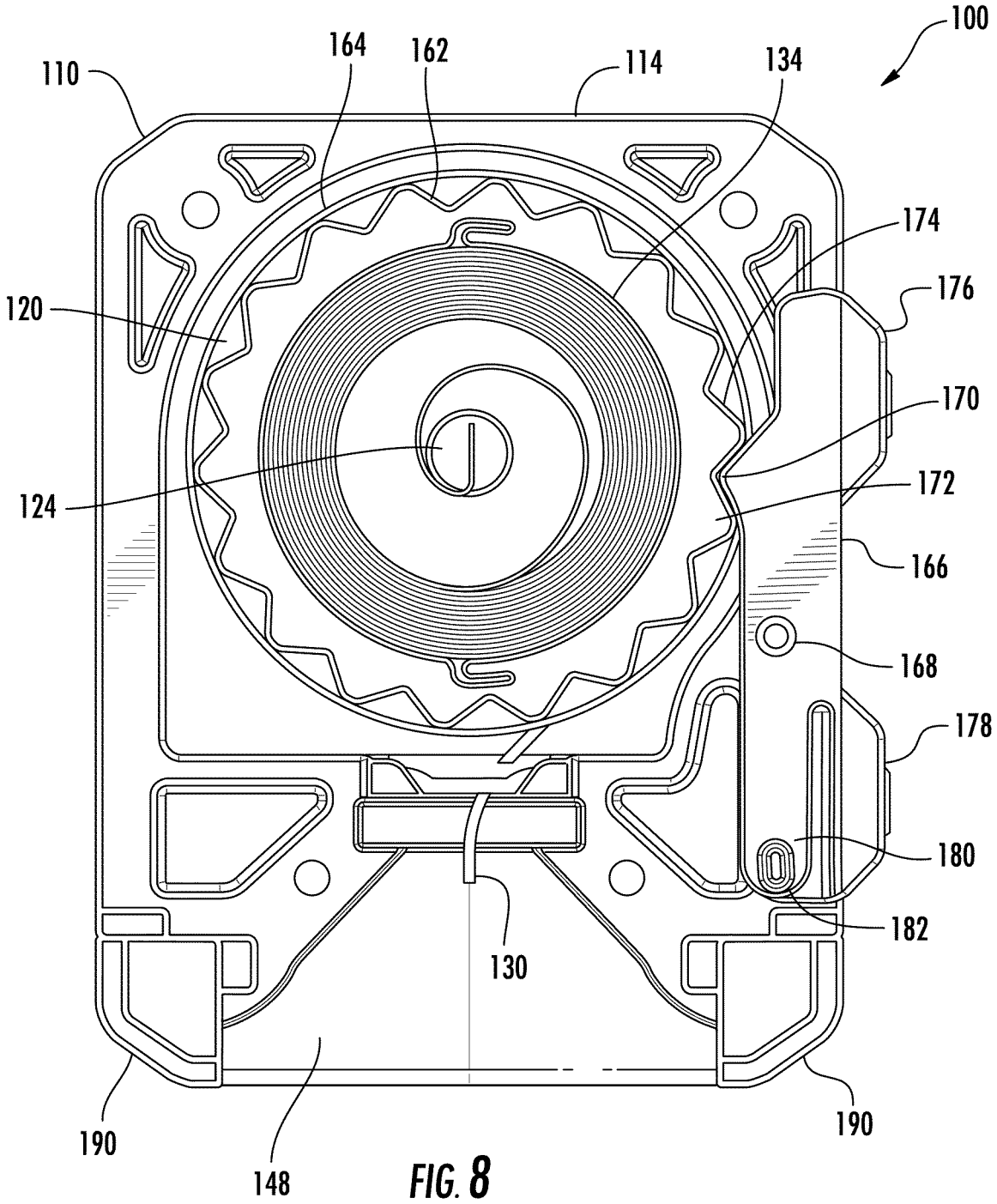
FIG. 8 is another section view of the equipment tether of FIG. 1.
Figure 9:
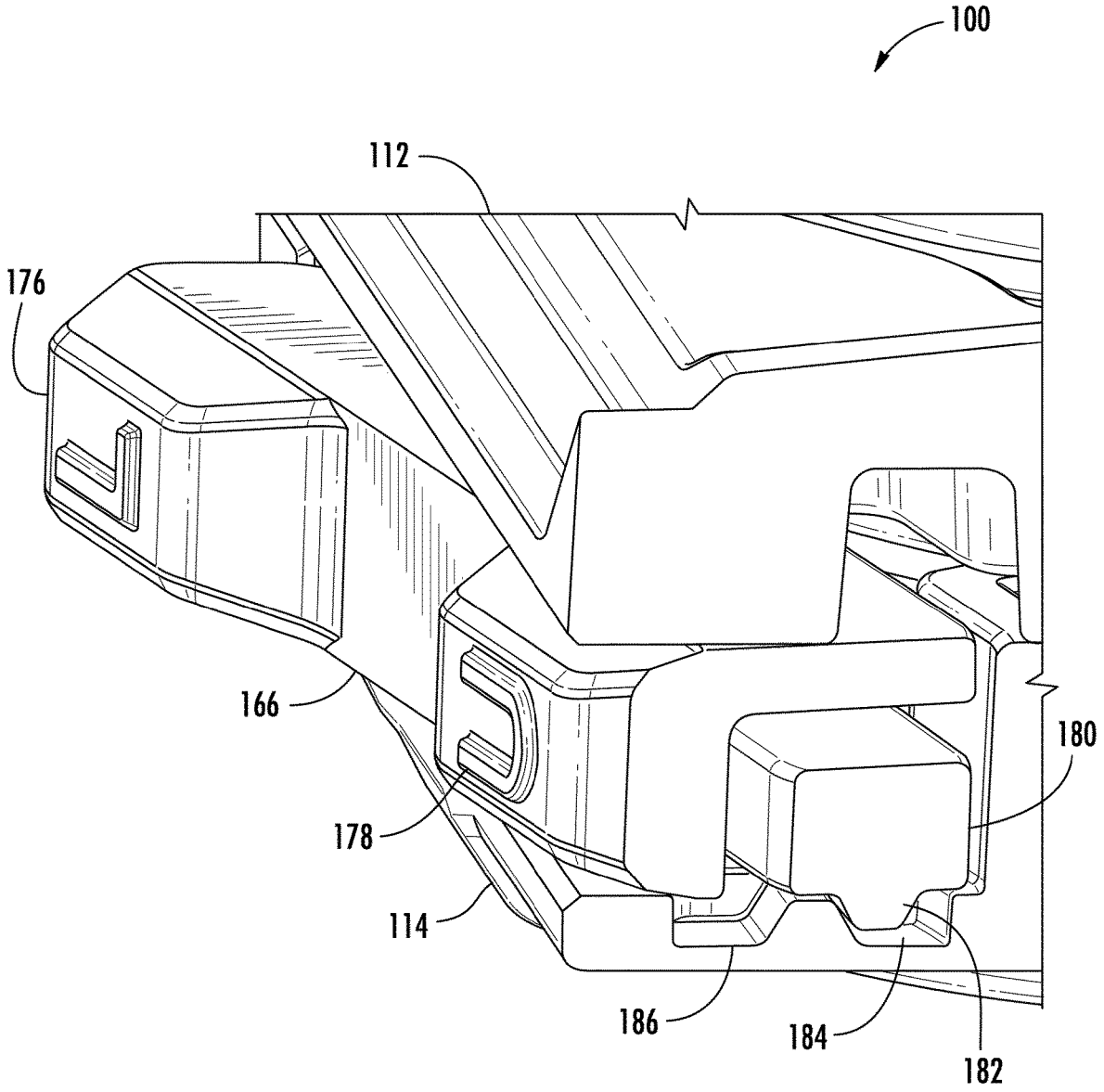
FIG. 9 is a section view of the retractor locking mechanism of the equipment tether of FIG. 1.
Figure 10:
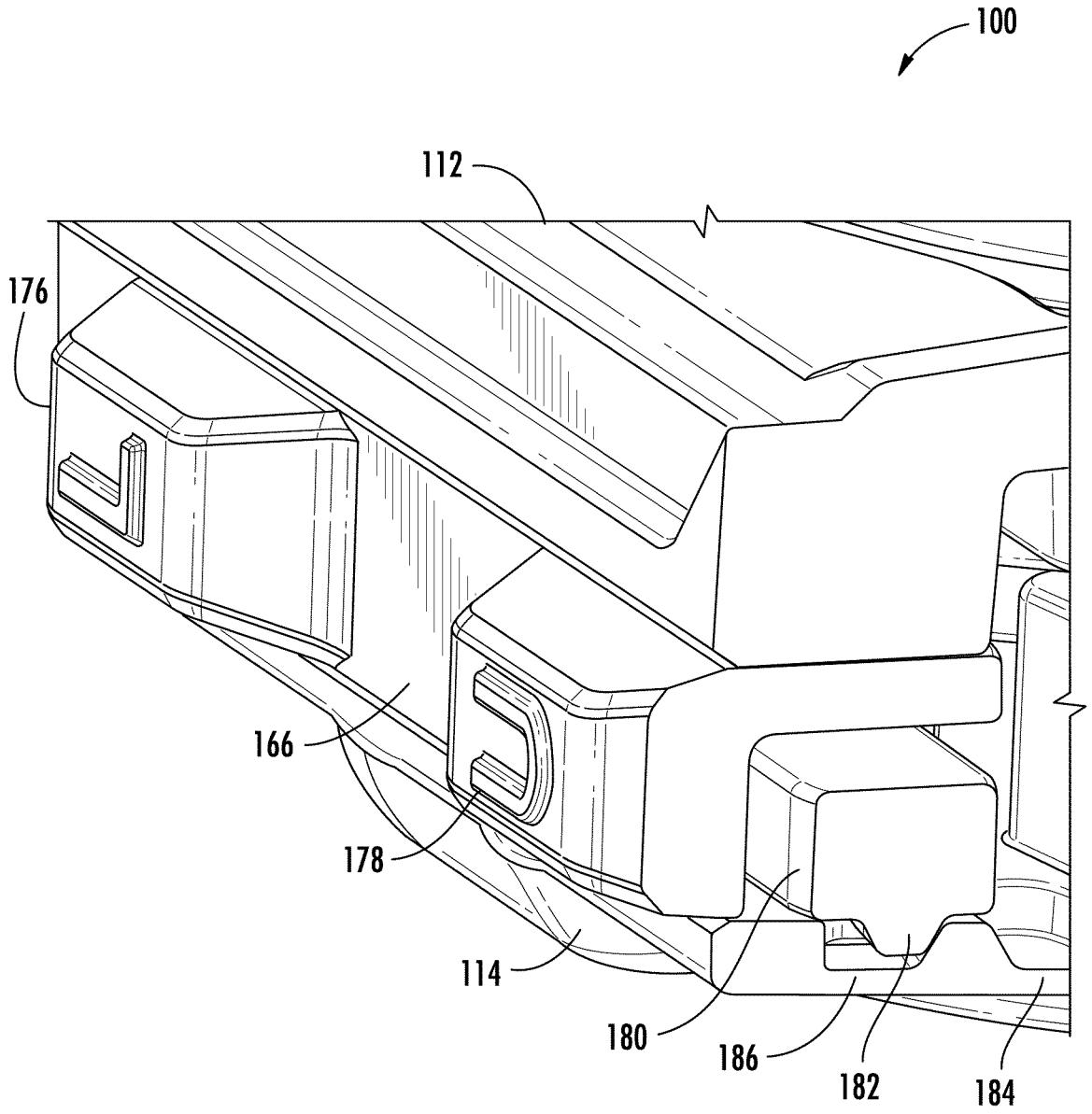
FIG. 10 is another section view of the retractor locking mechanism of FIG. 9.

Referring to FIGS. 6-8, the equipment tether 100 includes a retractor locking mechanism 160. The retractor locking mechanism 160 includes a gear 162 coupled to the spool 120. In some embodiments the gear 162 and the spool 120 are integrally formed from the same component. The gear 162 is fixed to the spool 120 such that the gear 162 and the spool 120 rotate together. The gear 162 is concentric with the spool 120 and rotates about the spool axis 122. The outside surface of the gear 162 includes a plurality of teeth 164. The retractor locking mechanism 160 further includes a retractor lock 166. The retractor lock 166 is configured to rotate about retractor lock axle 168, which is oriented parallel to the spool axle 124. The retractor lock 166 is located between the top half 112 and the bottom half 114 of the housing 110 and located so at least one surface of the retractor lock 166 is on the exterior of the equipment tether 100.

The retractor lock 166 is movable between a locked position and an unlocked position. In the unlocked position, shown in FIG. 7, the retractor lock 166 allows the spool 120 to rotate. In the locked position, shown in FIG. 8, a pawl 170 on the interior surface of the retractor lock 166 interfaces with two adjacent gear teeth 164, a locking tooth 172 and an unlocking tooth 174, preventing rotation of the spool 120. The distal ends of the locking tooth 172 and the unlocking tooth 174 form interior angles, and the interface between the locking tooth 172 and the unlocking tooth 174 forms an exterior angle. The locking tooth 172 and the unlocking tooth 174 are tapered and grow wider closer to the center of the gear 162. The pawl 170 may have a similar profile to the locking tooth 172 or the unlocking tooth 174. When in the locked position, the pawl 170 is received by the exterior angle between the locking tooth 172 and the unlocking tooth 174. To move the retractor lock 166 between the unlocked and locked positions, the user can push on the exterior surface of the retractor lock 166 to create a moment about the retractor lock axle 168. When moving from the unlocked position to the locked position, if the gear 162 is rotated such that the pawl 170 only contacts the unlocking tooth 174, the pawl 170 will push against the tapered surface of the unlocking tooth 174, rotating the gear 162 until the locked position of the retractor lock 166 is reached. The locked position is reached when the pawl 170 contacts both the locking tooth 172 and the unlocking tooth 174. A similar process occurs when the pawl 170 only contacts the locking tooth 172. In some embodiments, to facilitate pushing the retractor lock 166 past the outside surface of the housing 110, the end portions of the retractor lock 166 are raised to form a lock button 176 and an unlock button 178. In some embodiments, lock button 176 and unlock button 178 are marked. By way of example, the lock button 176 may be marked with an "L," whereas unlock button 178 may be marked with a "U."

In some embodiments, the retractor lock 166 includes a biasing member 180 with a protrusion 182, and the housing 110 defines an unlocked recess 184 and a locked recess 186, shown in FIGS. 7-10. The protrusion 182 is received by the unlocked recess 184 when the retractor lock 166 is in the unlocked position (shown in FIGS. 7 and 9) and by the locked recess 186 when in the locked position (shown in FIGS. 8 and 10). The protrusion 182 extends from the biasing member 180, and the biasing member 180 biases the protrusion 182 in the direction of the unlocked recess 184 and the locked recess 186. The extension of the protrusion 182 into the unlocked recess 184 or the locked recess 186 prevents the retractor lock 166 from freely moving between the locked and unlocked positions. The protrusion 182 has surfaces that mate with corresponding tapered surfaces of the unlocked recess 184 and the locked recess 186. When moving the retractor lock 166 from the unlocked position to the locked position, a threshold force (i.e., a threshold lock button force) is applied to the lock button 176, and the corresponding tapered surfaces of the protrusion 182 and the unlocked recess 184 are forced against each other with enough force to overcome the biasing force of the biasing member 180. The threshold lock button force imparts a threshold moment on the retractor lock 166 that is necessary to cause protrusion 182 to move to an unlocked position and the retractor lock 166 to rotate such that the protrusion 182 is proximate the locked recess 186. Once the protrusion is proximate the locked recess 186, the biasing member 180 forces the protrusion 182 into the locked recess 186. A similar process moves the protrusion 182 into the unlocked recess 184 in response to a threshold force on the unlock button 178 (i.e., a threshold unlock button force).

In some embodiments, the retractor lock 166 is configured to move from the locked position to the unlocked position in response to a threshold force on the cord 130 (i.e., a threshold cord force). A tensile force on the cord 130 imparts a moment load on the spool 120 in the extension direction, which is normally counteracted by the interface between the unlocking tooth 174 and the pawl 170. The mating surfaces of the unlocking tooth 174 and the pawl 170 have corresponding tapers that direct the moment load on the spool 120 to force the retractor lock 166 away from the spool 120. When the threshold tensile force is applied to the cord 130, the force on the retractor lock 166 from the locking tooth 172 imparts the threshold moment required to move the protrusion 182 to the unlocked position, moving the protrusion 182 out of the locked recess 186 and the retractor lock 166 to the unlocked position. The magnitudes of the threshold lock button force, the threshold unlock button force, and the threshold cord force necessary to impart the threshold moment vary based on a number of factors including the distances from the lock button 176 and the unlock button 178 to the retractor lock axle 168, the distance from the pawl 170 to the retractor lock axle 168, and the radius of the spool 120.

Figure 11:
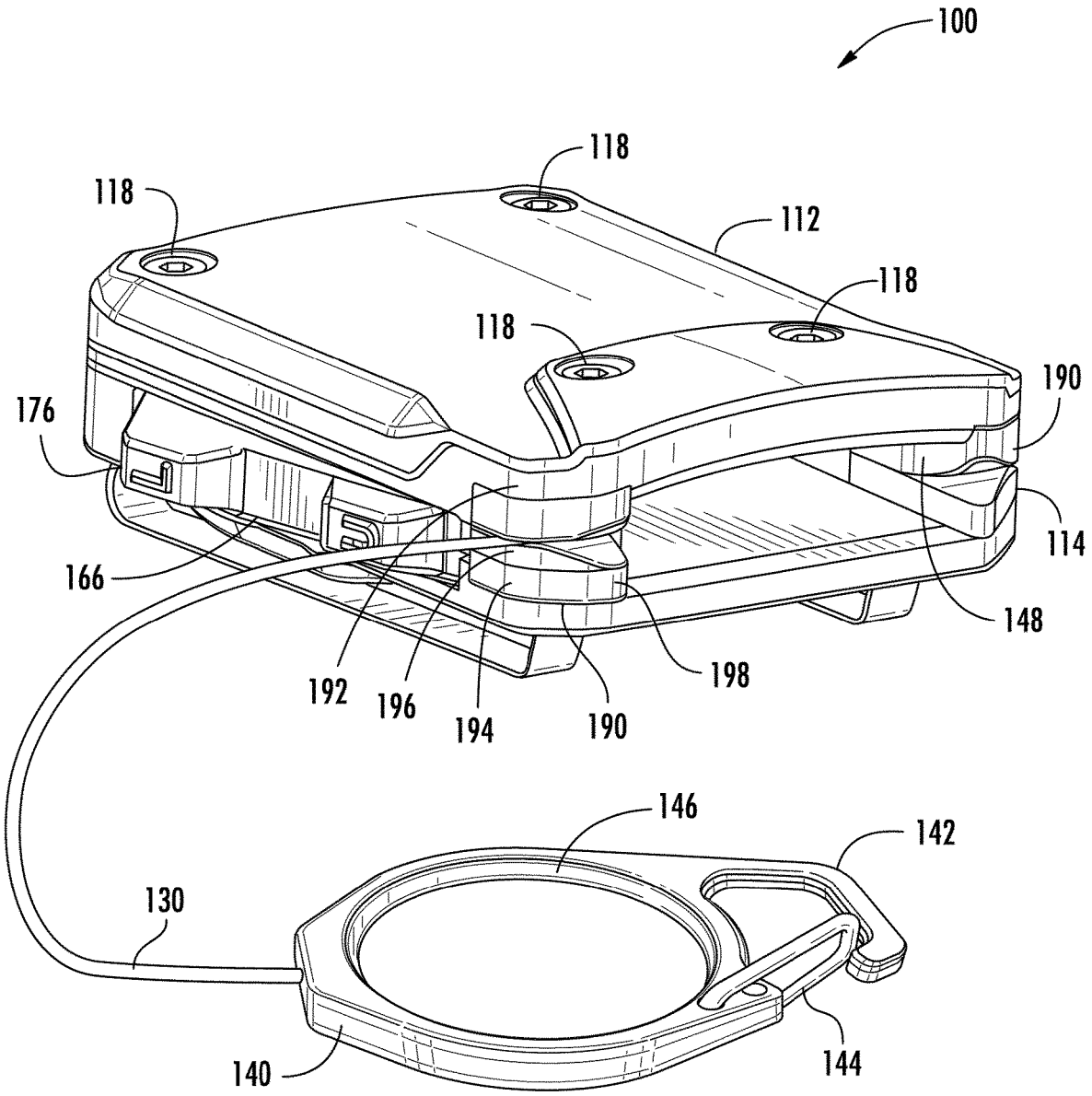
FIG. 11 is a perspective view of the equipment tether of FIG. 1.
Figure 12:
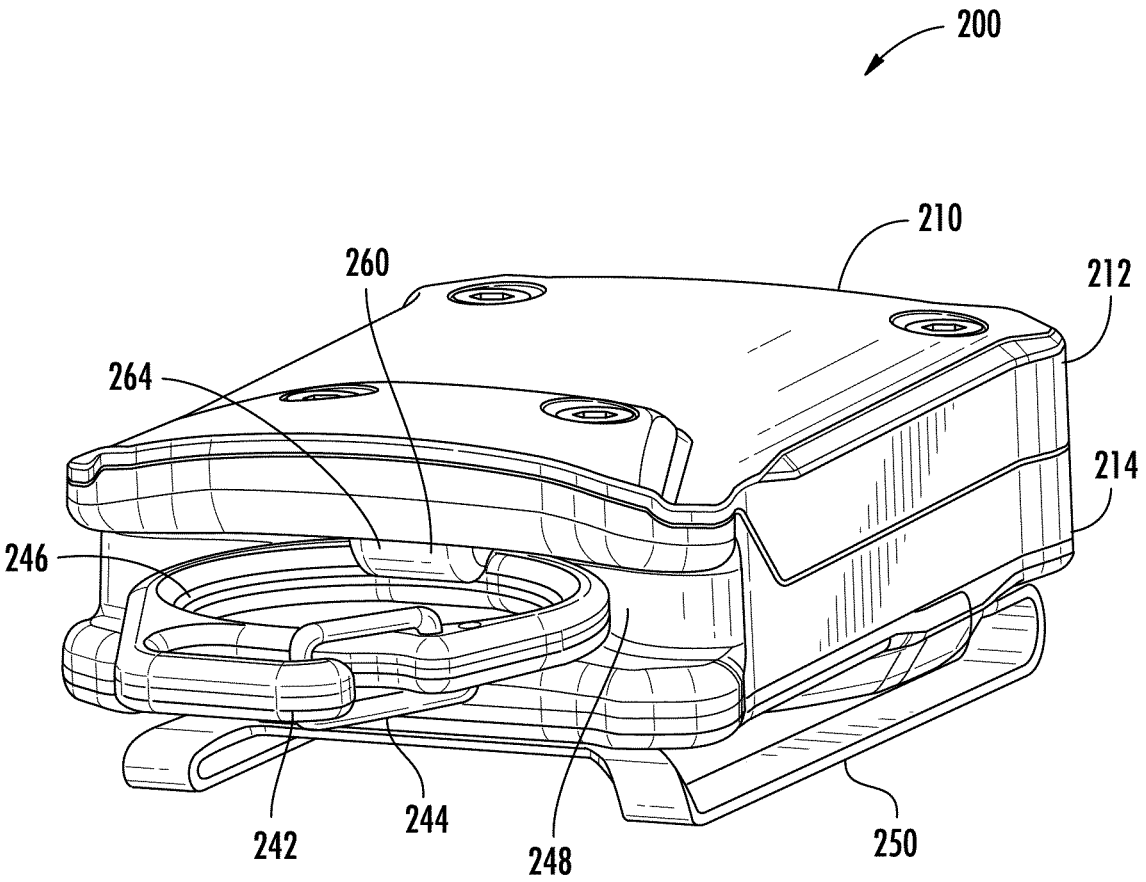
FIG. 12 is a perspective view of an equipment tether, according to an exemplary embodiment.
Figure 13:
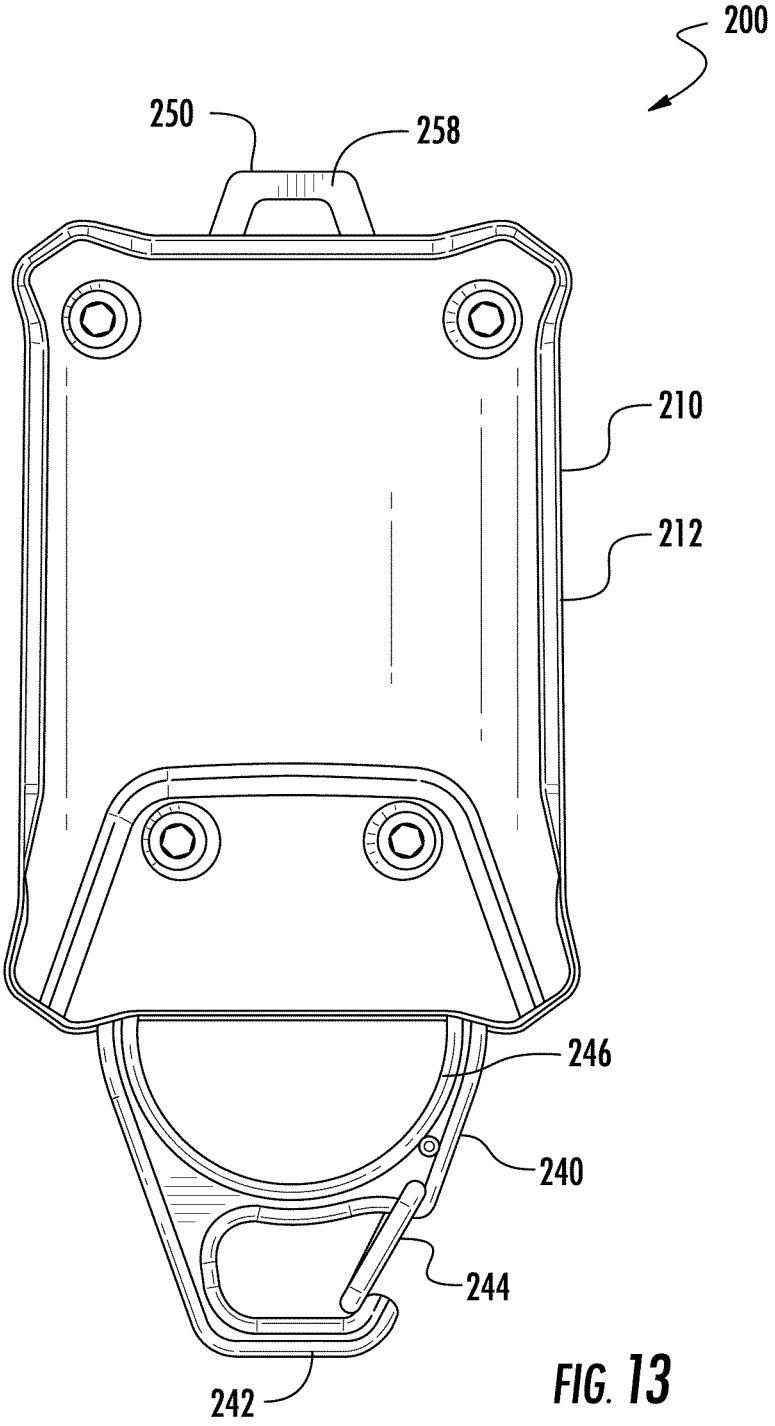
FIG. 13 is a top view of the equipment tether of FIG. 12.
Figure 14:
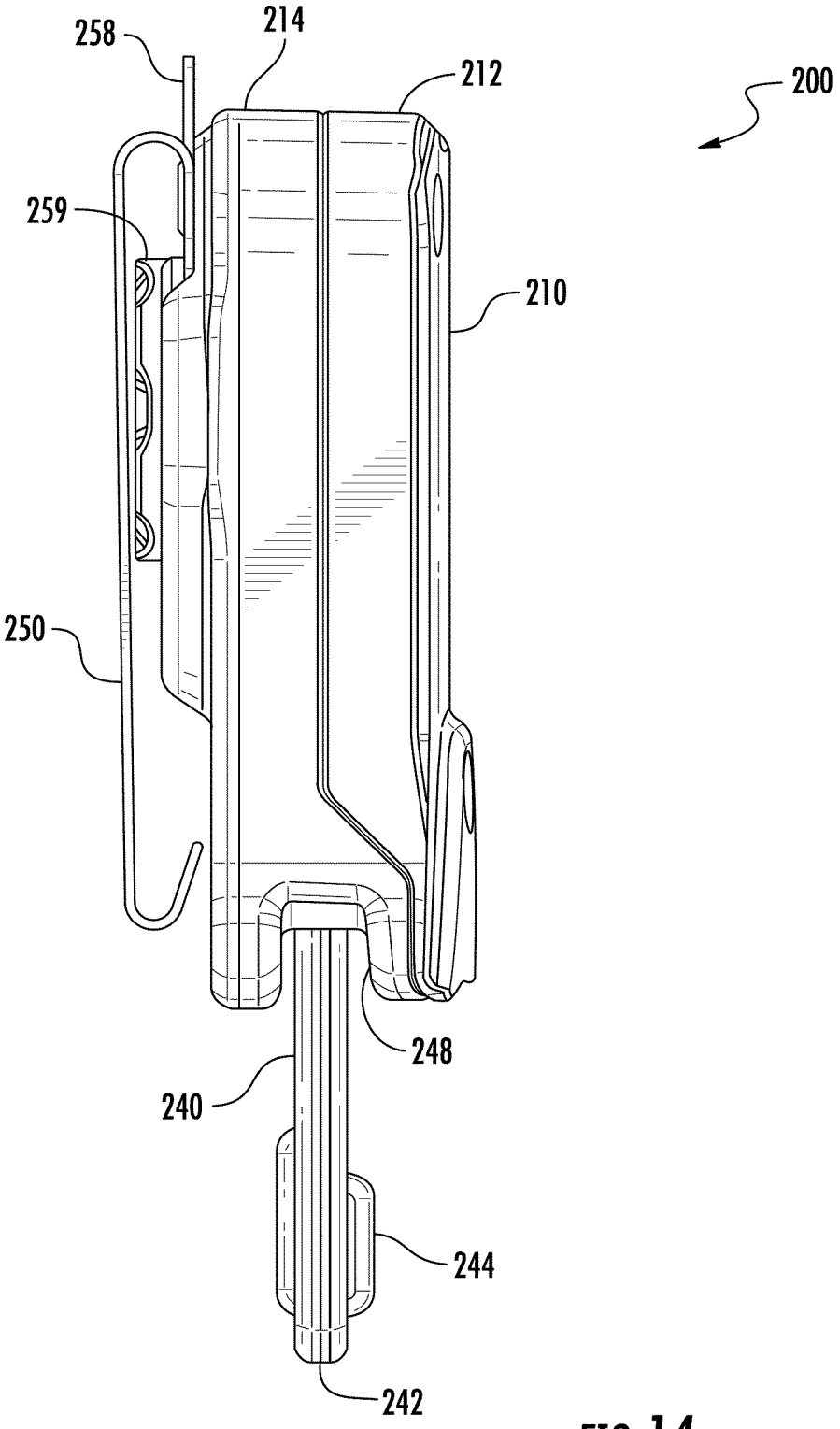
FIG. 14 is a side view of the equipment tether of FIG. 12.
Figure 15:
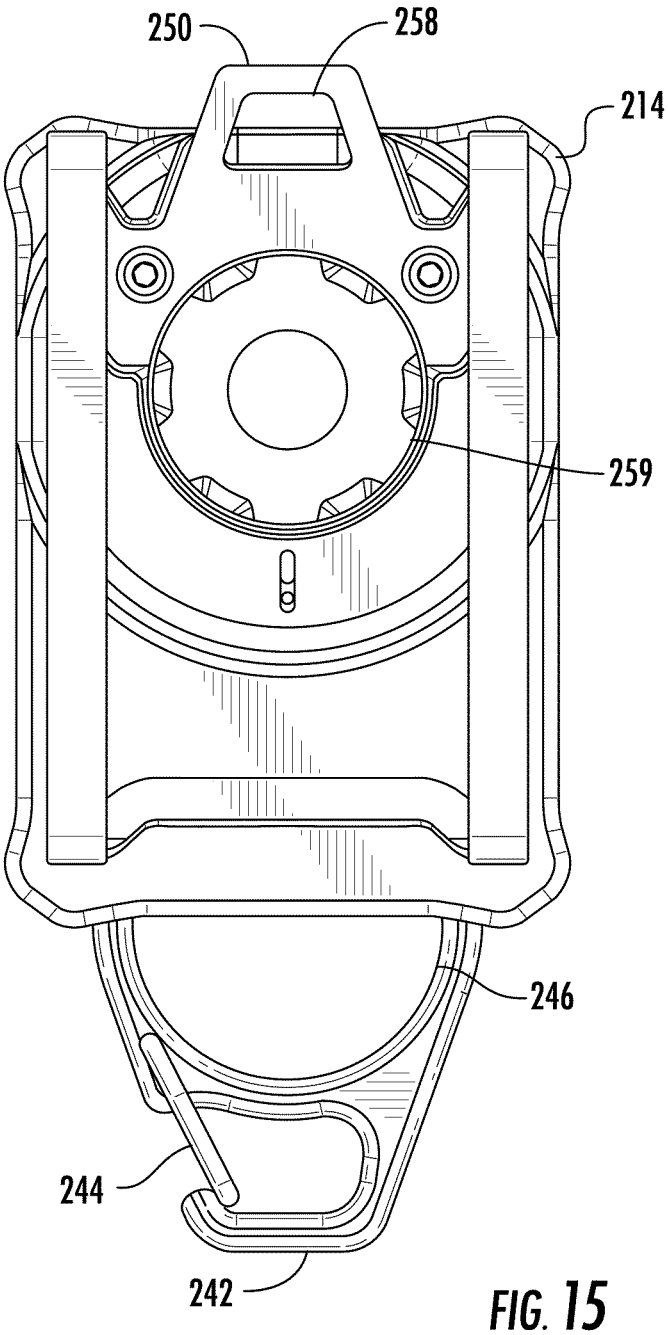
FIG. 15 is a bottom view of the equipment tether of FIG. 12.
Figure 16:
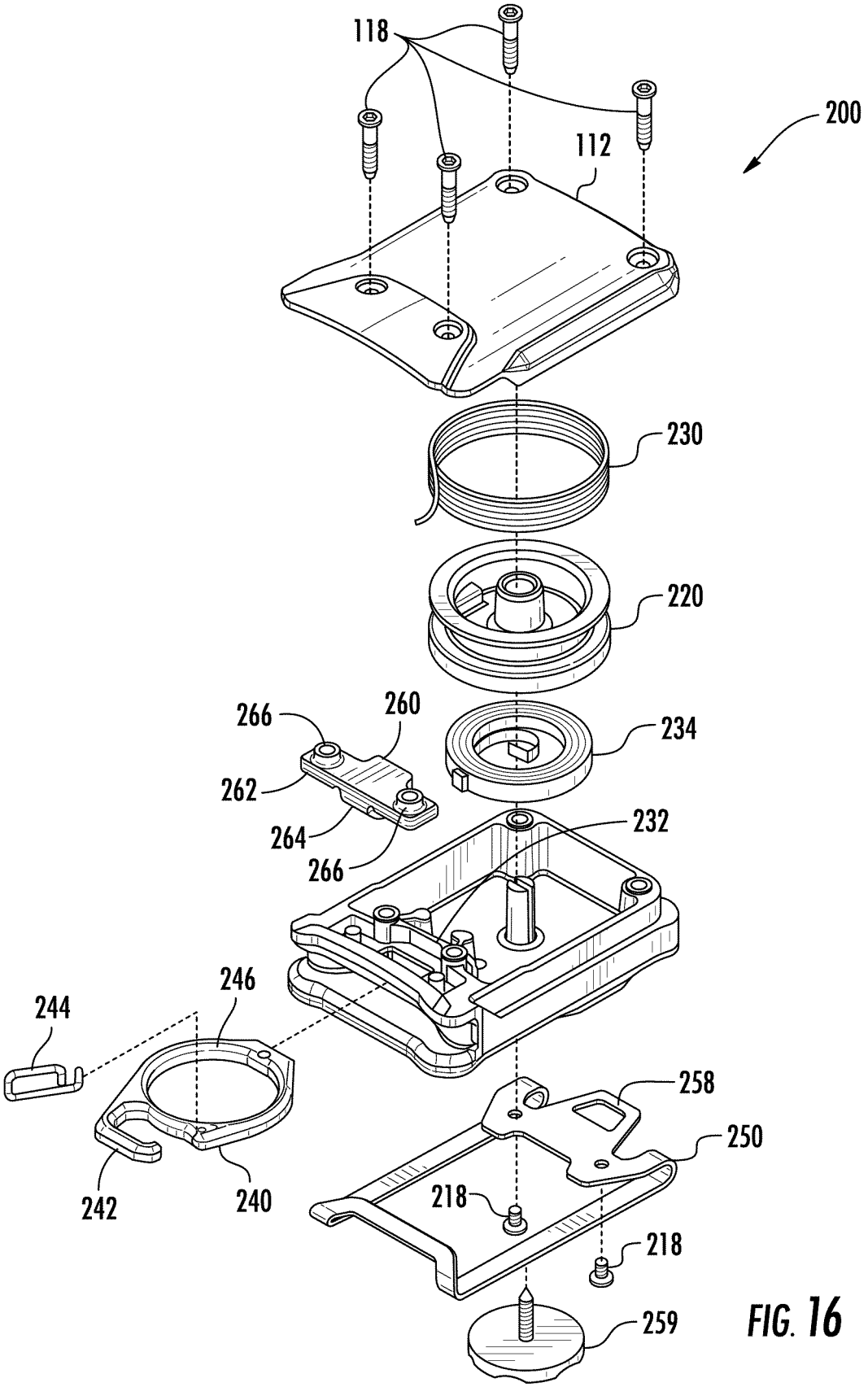
FIG. 16 is an exploded view of the equipment tether of FIG. 12.

Referring to FIG. 11, the equipment tether 100 further includes one or more cleats 190 that selectively prevent the cord 130 from retracting. The cleats 190 are located between the top cover 112 and the bottom cover 114 of the housing 110 and positioned on the exterior of the housing 110. In some embodiments, the cleats 190 enter into a recess of the housing 110 such that the housing 110 prevents movement of the cleats 190. In some embodiments, the cleats 190 can be removed from the housing 110 (e.g., by disassembling the housing 110 or a portion of the housing 110) and replaced. The cleats 190 are located near the corners of the housing 110 on the same side as the cord aperture 132. In some embodiments, the equipment tether 100 includes two cleats 190 to provide multiple locations to hold the cord 130. The first cleat 190 is located opposite the second cleat 190 with the cord aperture 132 located between the first cleat 190 and the second cleat 190. The cleats 190 are made from a single piece of flexible material and include a first lip 192 and a second lip 194 that define a slotted opening 196.

A user can extend the cord 130 out from the housing 110 and impart a side load on the cord 130. This brings the cord 130 towards the slotted opening 196 of one of the cleats 190. As the cord 130 passes into the slotted opening 196, the cleat 190 flexes to allow the cord 130 into the slotted opening 196. Once the cord 130 is inside the slotted opening 196, the cleat 190 grips the cord 130, preventing the cord 130 from moving into or out of the housing 110. The cord 130 can be removed from the cleat 190 by pulling the cord 130 directly away from the cord aperture 132. The cleats 190 allow the user to quickly relieve tension on the cord 130 without having to interact with (e.g., push a button on) the housing 110. The first lip 192 and the second lip 194 each additionally define tapers 198. Tapers 198 extend outward from the slotted opening 196 and direct the cord 130 towards the slotted opening 196. In some embodiments, there are one or more cleats 190. In some embodiments, the cleat 190 is formed from plastic (e.g., Hytrel) suitable for holding the cord 130 in wet conditions. Use of a flexible plastic in the cleat 190 prevents wear on the cord 130 that may be experienced by other tethers that use metal cleats. Forming the cleat 190 from a single piece provides increased gripping strength on the cord 130.

Referring to FIGS. 12-16, an equipment tether 200 is shown. The equipment tether 200 includes a housing 210 including a top half 212 and a bottom half 214 coupled using threaded fasteners 218. The housing 210 contains a spool 220, a cord 230 wrapped around the spool 220 that passes through a cord aperture 232 in the housing 210, and a spool biasing member 234 that biases the spool 220 to rotate in a rewinding direction. The cord 230 is coupled to a carabiner 240 used to couple the equipment tether 200 to another object. The carabiner 240 includes a carabiner hook 242 and a carabiner spring 244 and defines a carabiner aperture 246. The carabiner 240 is received by a carabiner recess 248 in the housing 210 when the cord 230 is fully retracted. A belt clip 250 including a lanyard aperture 258 is coupled to the housing 210 and secures the equipment tether 200 to the user. In some embodiments, the belt clip 250 also includes a pin 259 as an alternative to the means to secure the equipment tether 200 to the user. The pin 259 includes a pointed end that pierces cloth and passes into a hole in the housing 110 where it is secured (e.g., by a press fit, by a threaded connection, etc.). The other end of the pin 259 is connected to a flat plate that prevents the cloth from slipping off of the pin 259. The pin 259 allows the user to secure the equipment tether 200 to an article of clothing or a piece of equipment.

Figure 17:
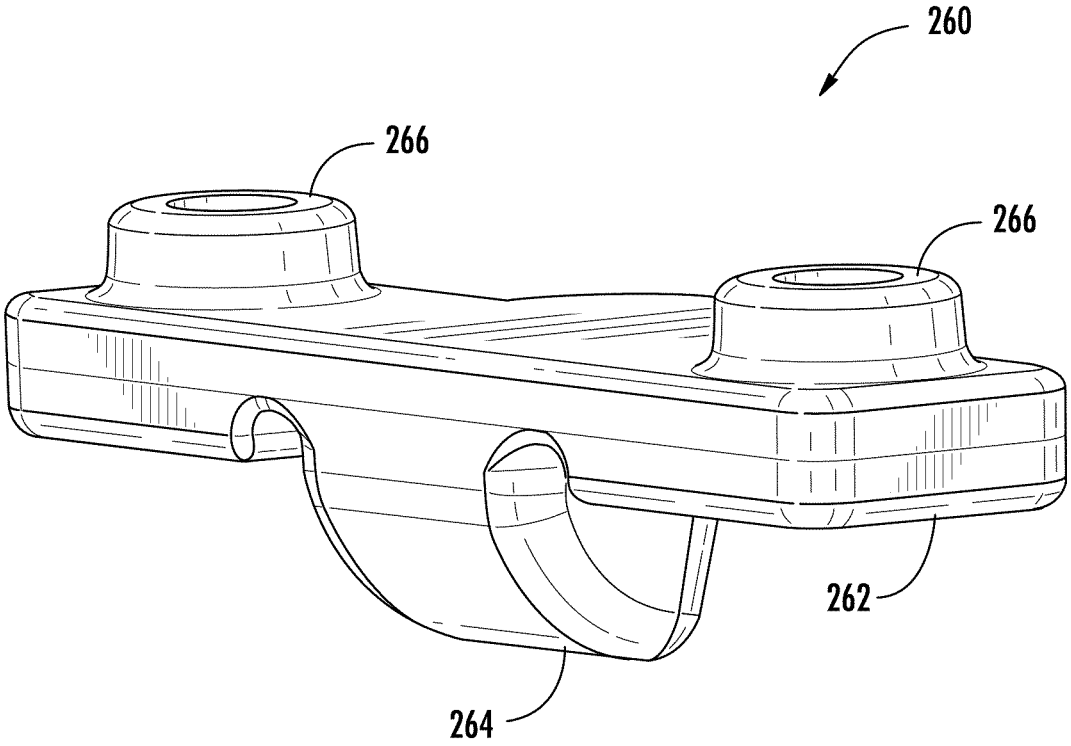
FIG. 17 is a perspective view of the carabiner lock of the equipment tether of FIG. 12.
Figure 18:
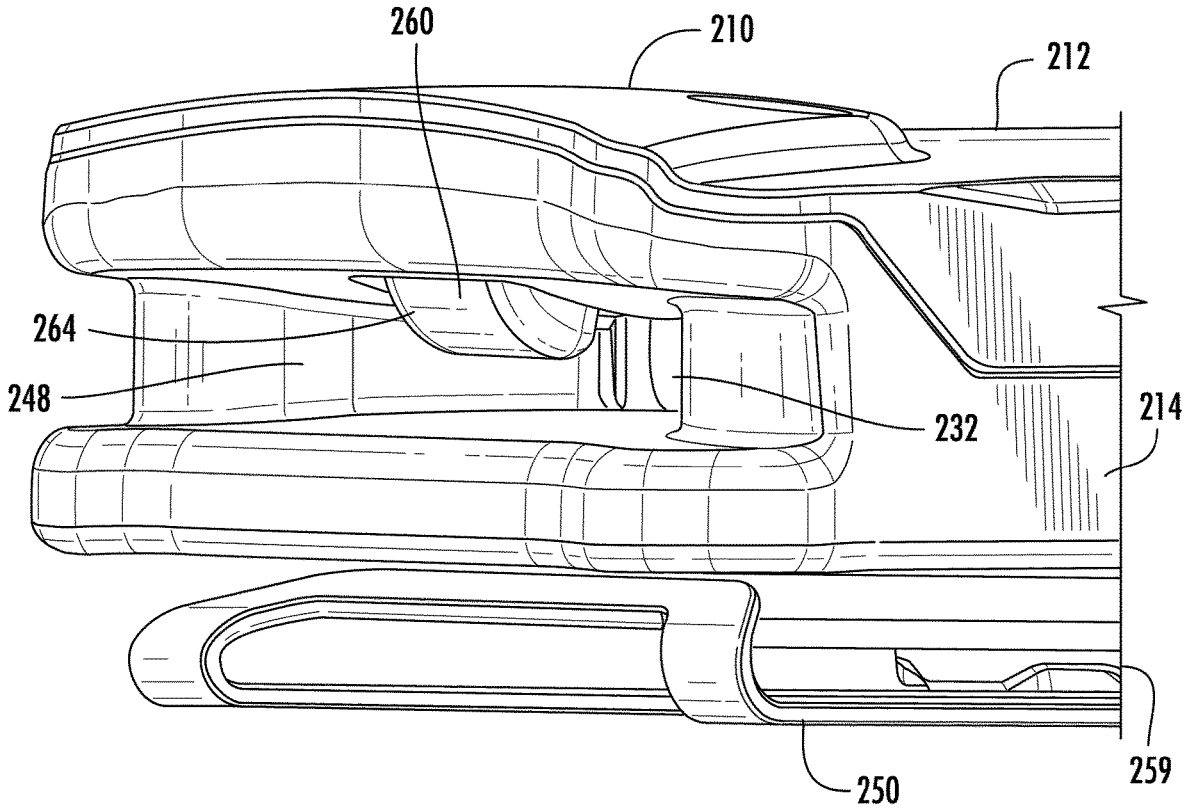
FIG. 18 is a detail view of the carabiner recess of the equipment tether of FIG. 12.
Figure 19:
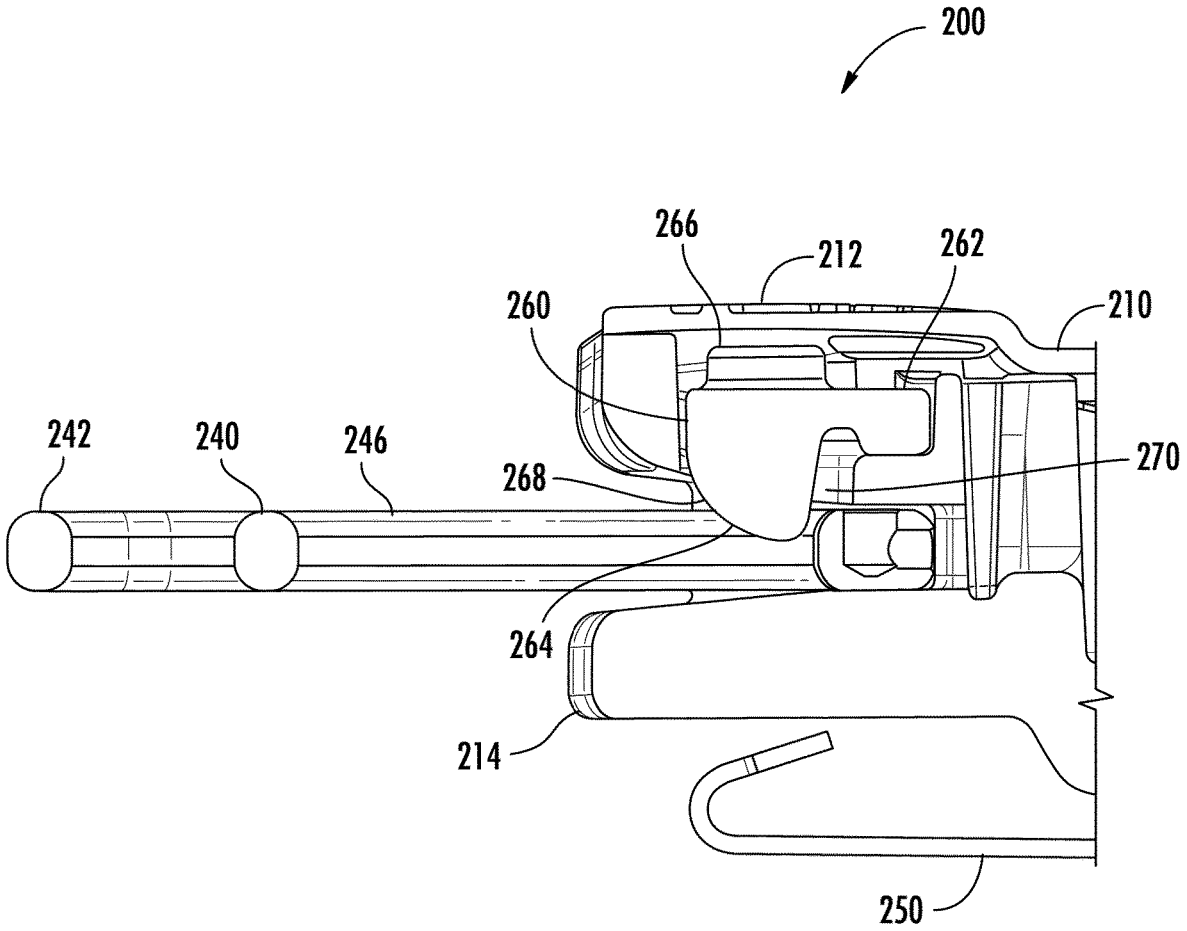
FIG. 19 is a section view of the carabiner recess of FIG. 18.

Referring to FIGS. 17-19, the equipment tether 200 includes a carabiner lock 260 that selectively holds the carabiner 240 in the carabiner recess 248. The carabiner lock 260 includes a base 262, a tooth or protrusion 264, and two feet 266, as shown in FIG. 17. The carabiner lock 260 extends partially within the housing 210, with the protrusion 264 extending partially outside the housing 210, as shown in FIGS. 18 and 19. The protrusion 264 is movable between an extended position for securing the carabiner 240 and a retracted position in which the carabiner 240 may pass by the carabiner lock 260. In one embodiment, at least the protrusion 264 is flexible or deformable (e.g., made of rubber, deformable plastic, etc.). In this embodiment, deforming the protrusion 264 causes the protrusion 264 to move from the extended position to the retracted position. In another embodiment, the protrusion 264 is rigid and biased out of the housing 210 by a carabiner lock biasing member. In this embodiment, the protrusion 264 moves from an extended position to a retracted position by deflecting the carabiner lock 260 and compressing the carabiner lock biasing member.

In the extended position, the protrusion 264 extends partially into the carabiner recess 248. When the carabiner 240 is fully seated in the carabiner recess 248, the protrusion 264 extends partially into the carabiner aperture 246, as shown in FIG. 19, to hold the carabiner 240 in the carabiner recess 248. This may also prevent the carabiner 240 from entering the carabiner recess 248. In the retracted position, the protrusion 264 deflects into the housing 210, allowing the carabiner 240 to pass into or out of the carabiner recess 248 unobstructed. When the carabiner 240 is removed from the carabiner recess 248, a first threshold force (i.e., a first threshold carabiner force) is exerted on the carabiner 240, forcing the protrusion 264 to move from the extended position to the retracted position and releasing the carabiner 240. When placing the carabiner 240 into the carabiner recess 248, a second threshold carabiner force is exerted on the carabiner 240, forcing the protrusion 264 to move from the extended position to the retracted position and allowing the carabiner 240 to pass into the carabiner recess 248. In some embodiments, the first threshold carabiner force and the second threshold carabiner force are the same. If no force is exerted on the protrusion 264, the protrusion 264 defaults to the extended position. In some embodiments, the front side 268 and rear side 270 of the protrusion 264 are tapered. In some embodiments, the front side 268 has a shallower taper than the rear side 270. This difference in taper angle allows the second threshold carabiner force to be less than the first threshold carabiner force. By way of example, this lessens the second threshold carabiner force necessary to return a tool connected to the equipment tether 200 to a stored position, while increasing the first threshold carabiner force to ensure that the tool will not accidentally be released from the stored position.

The construction and arrangement of the apparatus, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges or geometric relationships provided. Accordingly, these terms should be interpreted as indicating that insubstantial or inconsequential modifications or alterations of the subject matter described and claimed are considered to be within the scope of the invention as recited in the appended claims

What is claimed is:

1. A tether, comprising:

a housing defining a cord aperture;

a spool located within the housing and configured to rotate about a spool axis in either an extending direction or a rewinding direction;

a cord wound around the spool and configured to pass through the cord aperture;

a spool biasing member coupled to the spool and configured to bias the spool to rotate in the rewinding direction to retract the cord into the housing; and a retractor lock movable between a locked position and an unlocked position, wherein the retractor lock is configured to prevent rotation of the spool when in the locked position and allow rotation of the spool in the unlocked position, and wherein the retractor lock is configured to move from the locked position to the unlocked position in response to a threshold cord force on the cord;

wherein the housing defines a locked recess, wherein the retractor lock includes a protrusion that is configured to be received by the locked recess while the retractor lock is in the locked position to secure the retractor lock in the locked position, and wherein the protrusion is configured to exit the locked recess in response to the threshold cord force to allow the retractor lock to move to the unlocked position.

2. The tether of claim 1, further comprising a gear having a plurality of teeth and coupled to the spool, wherein the retractor lock includes a pawl configured to interface with at least one of the teeth when the retractor lock is in the locked position.

3. The tether of claim 2, wherein the housing defines an unlocked recess, wherein the retractor lock includes a protrusion that is configured to be received by the unlocked recess while the retractor lock is in the unlocked position to secure the retractor lock in the unlocked position, and wherein the protrusion is configured to exit the unlocked recess in response to a threshold lock button force on the retractor lock to allow the retractor lock to move to the locked position.

4. The tether of claim 1, further comprising a belt clip coupled to the housing and defining a lanyard aperture.

5. The tether of claim 1, further comprising a carabiner coupled to a distal end of the cord and configured to selectively couple the tether to another object.

6. The tether of claim 5, wherein the housing defines a carabiner recess, wherein the cord aperture is configured to open into the carabiner recess, and wherein the carabiner is configured to at least partially received by the carabiner recess when the cord is fully retracted.

7. The tether of claim 6, further comprising a carabiner lock including a protrusion configured to be movable between an extended position and a retracted position and configured to selectively hold the carabiner in the carabiner recess, wherein the protrusion is configured to move from the extended position to the retracted position in response to a threshold carabiner force being exerted on the carabiner to release the carabiner from the carabiner lock.

8. The tether of claim 7, further comprising a cleat defining a slotted opening, wherein the cleat is positioned on the exterior of the housing and configured to allow the cord to selectively pass into the slotted opening of the cleat, wherein the cleat is configured to prevent movement of the cord while the cord is located inside of the slotted opening, and wherein the cleat is formed from a single piece of flexible plastic.

9. A tether, comprising:

a housing defining a cord aperture that opens to a carabiner recess;

a carabiner lock including a protrusion movable between an extended position and a retracted position;

a spool located within the housing and configured to rotate about a spool axis in either an extending direction or a rewinding direction;

a cord wound around the spool and configured to pass through the cord aperture;

a spool biasing member coupled to the spool and configured to bias the spool to rotate in the rewinding direction to retract the cord into the housing; and a carabiner that defines a carabiner aperture, wherein the carabiner is coupled to a distal end of the cord;

wherein the carabiner is configured to selectively couple the tether to another object, wherein the carabiner is configured to enter into the carabiner recess when the cord is fully retracted, and wherein the protrusion is configured to move from the extended position to the retracted position in response to a threshold carabiner force being exerted on the carabiner to release the carabiner from the carabiner lock.

10. The tether of claim 9, wherein the protrusion is configured to extend partially into the carabiner aperture to hold the carabiner in the carabiner recess.

11. The tether of claim 10, wherein the carabiner lock is flexible, and wherein the protrusion is configured to deform when the carabiner is removed from the carabiner recess.

12. The tether of claim 10, wherein the carabiner lock includes a carabiner lock biasing member configured to bias the protrusion out of the housing, wherein the protrusion is rigid, and wherein the carabiner lock biasing member is configured to deform when the carabiner is removed from the carabiner recess.

13. The tether of claim 9, further comprising a belt clip coupled to the housing and defining a lanyard aperture.

14. A tether, comprising:

a housing defining a cord aperture;

a spool located within the housing and configured to rotate about a spool axis in either an extending direction or a rewinding direction;

a cord wound around the spool and configured to pass through the cord aperture;

a spool biasing member coupled to the spool and configured to bias the spool to rotate in the rewinding direction to retract the cord into the housing; and a cleat defining a slotted opening, wherein the cleat is positioned on the exterior of the housing and configured to allow the cord to selectively pass into the slotted opening of the cleat, wherein the cleat is configured to prevent retraction of the cord while the cord is located inside of the slotted opening, and wherein the cleat is formed from a single piece of flexible plastic.

15. The tether of claim 14, wherein the cord is configured to be removed from the cleat when the cord is pulled directly away from the cord aperture.

16. The tether of claim 15, wherein the cleat is a first cleat and further comprising a second cleat located opposite the first cleat with the cord aperture located between the first cleat and the second cleat.

17. The tether of claim 16, wherein the housing includes a top cover and a bottom cover, wherein the first cleat and the second cleat are located between the top cover and the bottom cover, and wherein the first cleat and the second cleat are configured to be removed from the housing.

18. The tether of claim 14, further comprising a belt clip coupled to the housing and defining a lanyard aperture.

19. The tether of claim 14, further comprising a carabiner coupled to a distal end of the cord and configured to selectively couple the tether to another object.

20. The tether of claim 19, wherein the housing defines a carabiner recess, wherein the cord aperture opens into the carabiner recess, and wherein the carabiner is configured to be received by the carabiner recess when the cord is fully retracted.

21. The tether of claim 20, further comprising a carabiner lock including a protrusion movable between an extended position and a retracted position and configured to selectively hold the carabiner in the carabiner recess, wherein the protrusion is configured to be moved from the extended position to the retracted position in response to a threshold carabiner force being exerted on the carabiner to release the carabiner from the carabiner lock.

22. The tether of claim 14, further comprising a retractor lock movable between a locked position and an unlocked position, wherein the retractor lock is configured to prevent rotation of the spool when in the locked position and allow rotation of the spool in the unlocked position, and wherein the retractor lock is configured to move from the locked position to the unlocked position in response to a threshold cord force on the cord.

* * * * *